US009073664B2

(12) United States Patent
Justice

(10) Patent No.: US 9,073,664 B2
(45) Date of Patent: Jul. 7, 2015

(54) CONTAINER WITH END SEALING FLAPS

(71) Applicant: International Paper Company, Memphis, TN (US)

(72) Inventor: Timothy Joe Justice, Williston, TN (US)

(73) Assignee: International Paper Company, Memphis, TN (US)

( * ) Notice: Subject to any disclaimer, the term of this patent is extended or adjusted under 35 U.S.C. 154(b) by 99 days.

(21) Appl. No.: 13/968,716

(22) Filed: Aug. 16, 2013

(65) Prior Publication Data

US 2015/0048149 A1 Feb. 19, 2015

(51) Int. Cl.

| | |
|---|---|
| ***B65D 5/00*** | (2006.01) |
| ***B65D 5/46*** | (2006.01) |
| ***B65D 5/468*** | (2006.01) |
| ***B65D 5/66*** | (2006.01) |
| ***B65D 5/28*** | (2006.01) |
| ***B65D 5/44*** | (2006.01) |

(52) U.S. Cl.

CPC ..... *B65D 5/4608* (2013.01); *B65D 5/6632* (2013.01); *B65D 5/28* (2013.01); *B65D 5/443* (2013.01)

(58) Field of Classification Search

CPC ..... B65D 5/6632; B65D 5/443; B65D 5/4608
USPC ..... 229/143, 142, 191, 919, 167
See application file for complete search history.

(56) References Cited

U.S. PATENT DOCUMENTS

| | | | | | |
|---|---|---|---|---|---|
| 2,727,675 | A | * | 12/1955 | Mairs et al. | 229/122.24 |
| 3,228,710 | A | * | 1/1966 | Chodorowski | 281/38 |
| 3,899,120 | A | | 8/1975 | Fradkin | |
| 4,177,935 | A | | 12/1979 | Centanni | |
| 4,530,685 | A | | 7/1985 | Freeman | |
| 4,621,766 | A | * | 11/1986 | McClure | 229/117.17 |
| 5,002,221 | A | | 3/1991 | Ragan | |
| 5,072,876 | A | | 12/1991 | Wilson | |
| 5,167,606 | A | | 12/1992 | Kuchenbecker | |
| 5,611,425 | A | | 3/1997 | Holley, Jr. | |
| 6,135,347 | A | * | 10/2000 | Mueller | 229/183 |
| 6,234,385 | B1 | | 5/2001 | Espinoza et al. | |
| 2005/0014621 | A1 | | 1/2005 | McClure | |
| 2007/0000984 | A1 | * | 1/2007 | McClure | 229/143 |
| 2008/0149696 | A1 | * | 6/2008 | Kuhn et al. | 229/142 |

* cited by examiner

*Primary Examiner* — Christopher Demeree
(74) *Attorney, Agent, or Firm* — Matthew M. Eslami

(57) ABSTRACT

The present invention is directed to a container comprises a bottom wall, opposite sidewalls, and opposite end walls all of which foldably joined to one another to form an interior space to receive products therein. A respective first and second top wall panels is foldably joined to respective longitudinal edges of the opposite sidewalls. A first pair of end sealing flaps each of which is foldably joined to respective lateral edge of the first top wall panel. A second pair of end sealing flaps each of which is foldably joined to respective lateral edge of the second top wall panel and wherein the first and second top wall panels is capable of being partially overlapped to cover the interior space without each of the respective end sealing flaps being substantially overlapped with one another when the container is enclosed with the product.

2 Claims, 3 Drawing Sheets

CONTAINER WITH END SEALING FLAPS

FIELD OF THE INVENTION

The present invention relates generally to paperboard and/or corrugated containers that are capable of shipping articles, and more particularly, to a container having improved end sealing tabs and constructed from a single blank.

BACKGROUND OF THE INVENTION

Conventional foldable containers are well known and are used in a variety of applications. For example, the packaging industry utilizes a vast number of containers in which numerous products are packaged for subsequent shipment. The container currently used in the vast majority of beef/poultry markets uses sealing flaps to keep the container closed for security and sanitation. These containers are moved manually several times before they arrive at the end user, and the strength of the hand-hold area of the container is critical to the package surviving the distribution network. The current sealing flaps are substantially overlapped and it is often difficult to completely glue the outer sealing flap over the inner sealing flap which results either in reduced strength in hand hold area or sealing flap pops open causing customer complaints and also labor time to re-glue the flap.

Accordingly, there is a pressing need to for a one piece container that will provide end sealing flaps that overcome the drawback of the above-mentioned containers.

SUMMARY OF THE INVENTION

One advantage of the present invention is that the end sealing flaps are not substantially overlapped. Another advantage is that the end sealing flaps are strategically positioned so as to substantially increase the strength of the hand-hold area when compared to the overlapping configuration of the end sealing flaps. Furthermore, the end sealing flaps of the present invention significantly improves the attaching means of the sealing flaps to the end walls, irrespective of the position of the sealing flaps and it reduces customer re-work cost. The container with the end sealing flaps is constructed from a single blank using one piece of equipment and thus presents a great cost savings over a container formed from two separate blanks.

Accordingly, one aspect of the present invention is directed to a container comprises a bottom wall, opposite sidewalls, and opposite end walls all of which foldably joined to one another to form an interior space to receive products therein. A respective first and second top wall panels is foldably joined to respective longitudinal edges of the opposite sidewalls. A first pair of end sealing flaps each of which is foldably joined to respective lateral edge of the first top wall panel. A second pair of end sealing flaps each of which is foldably joined to respective lateral edge of the second top wall panel and wherein the first and second top wall panels is capable of being partially overlapped to cover the interior space without each of the respective end sealing flaps being substantially overlapped with one another when the container is enclosed with the product.

Another aspect of the present invention is directed to a container comprises a bottom wall, opposite sidewalls, and opposite end walls all of which are foldably joined to one another to form an interior space to receive products therein. The respective first and second top wall panel is foldably joined to respective longitudinal edges of the opposite sidewalls. A first pair of end sealing flaps each of which is foldably joined to respective lateral edge of the first top wall panel wherein the first pair of the end sealing flaps is aligned with the longitudinal edge of the top wall panel and is folded downwardly over the adjacent respective end walls and secured thereto. A second pair of end sealing flaps each of which is foldably joined to respective lateral edge of the second top wall panel wherein the second pair of the end sealing flaps is offset from the longitudinal edge of the top wall panel and is folded downwardly over the adjacent respective end walls and secured thereto. The first and second top wall panels is capable of being partially overlapped to cover the interior space without each of the respective end sealing flaps being substantially overlapped with one another when the container being enclosed with the product.

A further aspect of present invention is directed to a single unitary blank for making a container having a bottom wall, opposite sidewalls, opposite end walls, first and second top wall panels. The blank is cut and scored to define a first section, a second section, and a third section. The first section is defined by the bottom panel wall having two side wall panels foldably joined thereto and the respective first and second top wall panels being foldably joined to the respective side wall panels. Each of the first and second top wall panels comprises a pair of first and second end sealing flaps are foldably joined to respective opposed lateral free edges of the respective first and second top wall panel. The second section comprises one of the opposed end wall panel having respective reinforcing panels 54*a*', 56*a*', 58*a*' and respective reinforcing panels 54*b*', 56*b*', 58*b*' being foldaly joined thereto. The third section comprises the other opposed end wall panel having respective reinforcing panels 54*c*', 56*c*', 58*c*' and respective reinforcing panels 54*d*', 56*d*', 58*d*' being foldaly joined thereto. Four identical diagonal corner panels are formed on the second and third sections which two of the diagonal corner panels are formed on the second section and the other two diagonal corner panels are formed on the third section. Each of the diagonal corner panels is formed between the respective reinforcing panels. Interposed with respective fold lines 24', 28' are relief profiles which are arranged cuts that lie substantially transverse the respective fold lines 24'and 28'.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
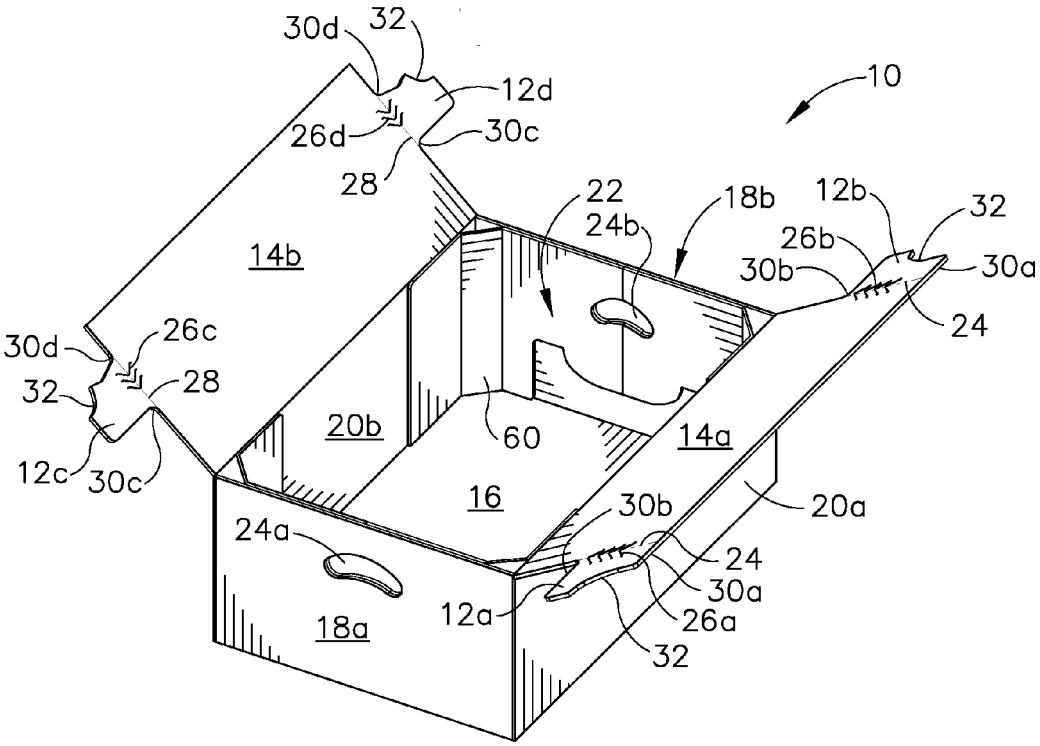
FIG. 1 is a top perspective view of a container having a plurality of end sealing flaps formed thereto in an open position in accordance to the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. In the present invention the use of prime character in the numeral references in the drawings directed to the different embodiment indicate that those elements are either the same or at least function the same. It should be understood that fold lines and score line as used herein may be used interchangeably so long as the function of the line is not destroyed.

Figure 2:
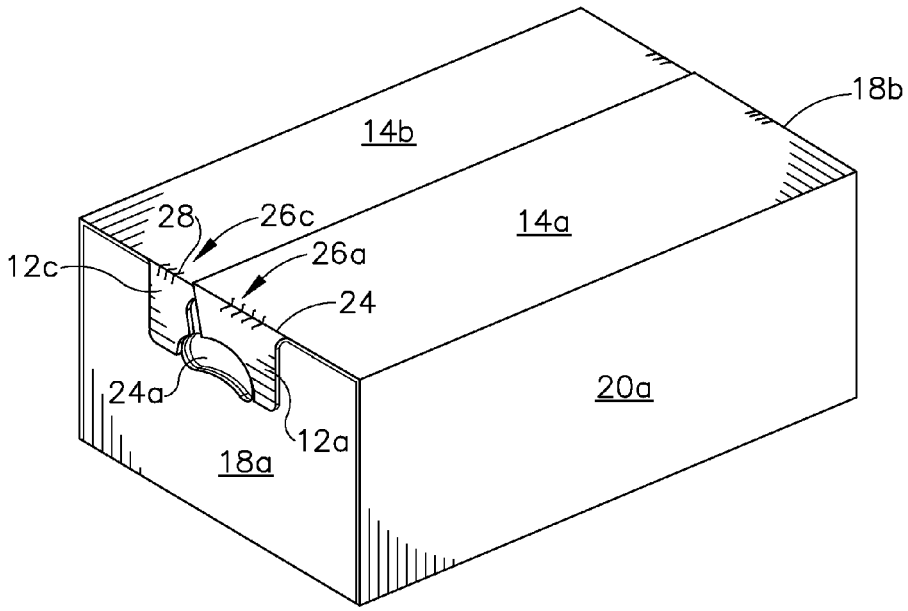
FIG. 2 is a top perspective view of the container in FIG. 1 showing the container in a closed position.
Figure 3:
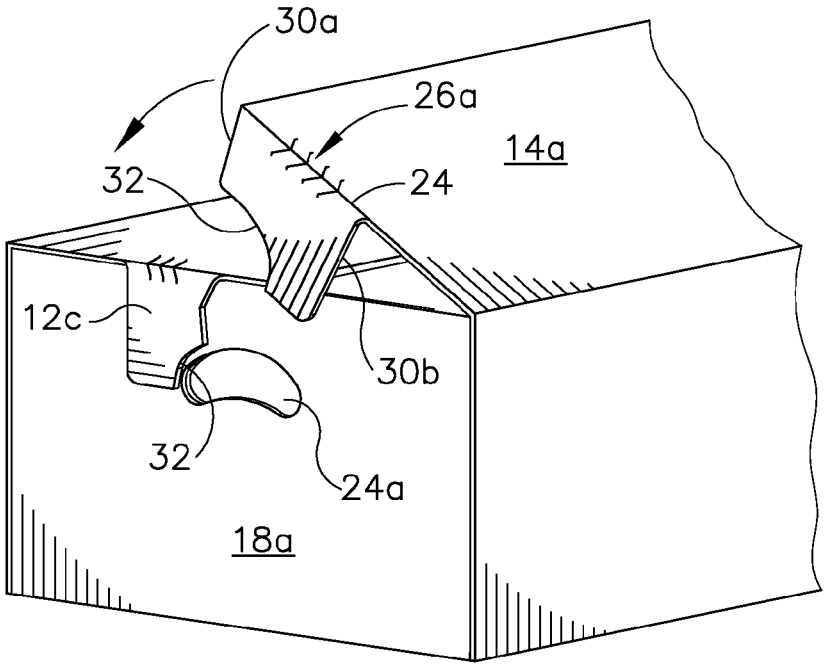
FIG. 3 is a top perspective view of a portion of the container in FIG. 1 illustrating the position of the end sealing flaps on the end wall of the container.

FIG. 1 is a top perspective view of a container 10 having four end sealing flaps 12*a*, 12*b*, 12*c*, 12*d* formed thereto in an open position in accordance to the present invention. The container 10 comprises opposing first and second top walls 14*a*, 14*b*, a bottom wall 16, opposing end walls 18*a*, 18*b*, and opposing side walls 20*a*, and 20*b*. The opposing side walls 20*a*, 20*b*, the opposing end walls 18*a*, 18*b* are all foldably joined to the bottom wall 16 to form an interior space 22. Each of the opposing first and second top walls panels 14*a*, 14*b* is foldably joined to the opposed longitudinal edges of the side walls 20*a*, 20*b*, respectively. Two handhold openings 24*a*, 24*b* each of which is formed on the respective end wall panels 14*a*, 14*b*. The first top wall panel 14*a* comprises a pair of first end sealing flaps 12*a*, 12*b* and the top wall panel 14*b* comprises a pair of second end sealing flaps 12*c*, 12*d*. The respective first end sealing flaps 12*a*, 12*b* are foldably joined from respective opposed lateral free edges of the first top wall panel 14*a* via fold lines 24 and respective second end sealing flaps 12*c*, 12*d* are foldably joined from respective opposed lateral free edges of the second top wall panel 14*b* via fold lines 28. It should be noted that the strategic location of the respective first end sealing flaps 12*a*, 12*b* and the respective second end sealing flaps 12*c*, and 12*d* greatly enhances the strength of the container in the respective end walls 18*a*, 18*b* regions, particularly, in proximity of the handhold opening 24 when the container is packed with products and is fully enclosed. For example, as depicted in FIGS. 1-3, the length L1 of respective first end sealing flaps 12*a*, 12*b* is shorter than the width W1 of the first top wall panel 14*a* and one end of the respective first end sealing flaps 12*a*, 12*b* is aligned with one of the longitudinal edges of the first top wall panel 14*a*. However, the ends of the respective second end sealing flaps 12*c*, 12*d* is offset from the longitudinal edges of the lateral edges of the second top wall panel 14*b* and the length L2 of the respective second end sealing flaps 12*c*, 12*d* is shorter than the width W2 the second top wall panel 14*b*. Each of the respective first and second end sealing flaps 12*a*, 12*b*, 12*c*, 12*d* includes a cut out 32 formed on the respective free edge, which in the folding position, to be aligned with the peripheral of the respective hand holds openings 24*a* and 24*b*. However, one of ordinary skill in the art would appreciate that the respective cut out 32 has no effect on the scope of the invention and it is within the scope of the invention that the respective first and second end sealing flaps 12*a*, 12*b*, 12*c*, and 12*d* may be positioned away from the handholds 24*a*, 24*b* when they are attached to the end walls 18*a*, 18*b*. It was also noted during production trial that when the respective end sealing flaps 12*a*, and 12*c* are slightly overlapped in proximity of the top wall panels 14*a*, 14*b*, the end sealing flaps strength increases by 20%.

While this specific embodiment of the present invention has two side walls 20*a*, 20*b* and two end walls 18*a*, 18*b*, the container 10 may have any number of side walls or end walls so long as the container's functions described herein are not compromised. The first and second handhold openings 24*a*, 24*b* are formed in the respective end walls 18*a*, 18*b*. Although the handhold openings 24*a*, 24*b* are optional, but for the present invention, it should also be noted that the hand hold openings 24*a*, 24*b* are formed in a manner that permits a user to carry the container 10 by the handhold openings without compromising the interior of the container 10. The container 10 may contain any number of hand hold openings; however, in the preferred embodiment of the present invention, the container 10 includes two hand hold openings 24*a*, 24*b*. The container 10 can be constructed from any one or more blanks that are capable of being folded and erected to form the container 10. However, in the preferred embodiments of the present invention the container 10 is made from one piece blank. Interposed with respective fold lines 24, 28 are relief profiles 26*a*, 26*b*, 26*c*, and 26*d*. The relief profiles 26*a*, 26*b*, 26*c*, and 26*d* are arranged cuts that lie substantially transverse the respective fold lines 24, 28. The relief profiles 26*a*, 26*b*, 26*c*, and 26*d* may be of any geometric shape such as V-shaped as best seen in FIGS. 1-3. Still other shapes are considered within the scope of this invention, such as, without limitation, C-shaped (not shown), U-shaped (not shown) or any other known geometric shape the may be placed transverse of the fold lines or score lines 24, 28.

Figure 4:
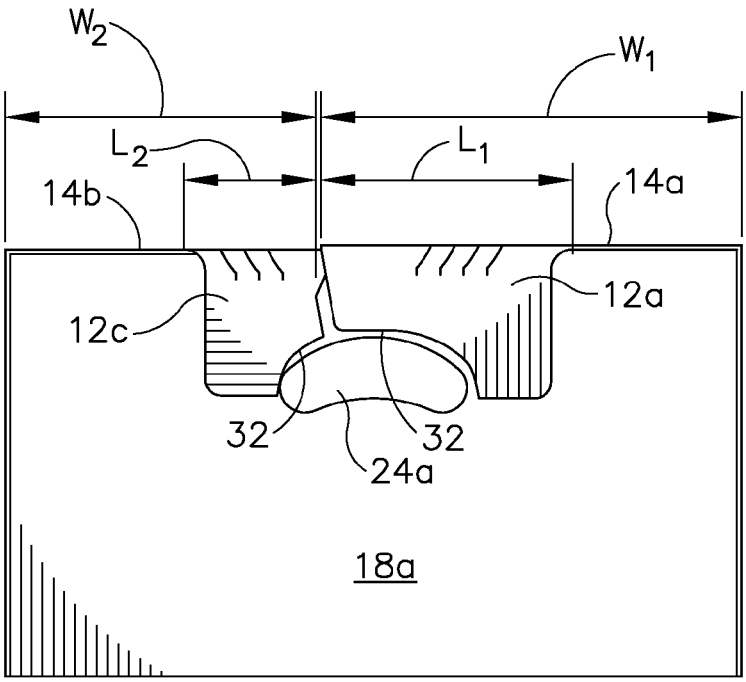
FIG. 4 illustrate an end view of the container in FIG. 3 illustrating the manner in which the end sealing flaps attached to the end wall of the container.

FIG. 2 is a top perspective view of the container 10 in FIG. 1 showing the container 10 in a closed position. The first end sealing flaps 12*a*, 12*b* are attached to the end wall 18*a* and the second end sealing flaps 12*c*, 12*d* are attached to the end wall 18*b* which is hidden from view in FIG. 2. It should be noted that the first top wall 14*a* is partially overlapped onto the second top wall panel 14*b*, but their respective end sealing flaps 12*a* and 12*c* are slightly spaced apart from one another. This configuration greatly enhances the strength of the container 10 around the respective handhold openings 24*a*, 24*b*. However, it should be noted that the respective end sealing flaps 12*a* and 12*c* are slightly overlapped at the proximity of their respective top wall panels 14*a* and 14*b* as best depicted in FIG. 4. Although in FIGS. 2 and 3, the top wall 14*a* is partially overlapped onto the second top wall panel 14*b*, but an ordinary skilled in the art would appreciate that the first top wall panel 14*b* may be partially overlapped onto the first top wall 14*a* and the configuration of the end sealing flaps 12*a* and 12*c* may be reversed as well. Furthermore, the end sealing flaps 12*a* and 12*c* may have the same lengths L1 and L2 or other various lengths for the end sealing flaps are within the scope of the present invention. It should also be noted that the container is constructed from relatively thicker material, such as, double or triple wall corrugated material or in overlapped panels. Specifically, the relief profiles 26*a*, 26*b*, 26*c*, and 26*d* have been found to greatly reduce the amount of folding force required to form the container 10. This is done by the relief profiles partially relieving the tensional and compressive forces about the fold lines or score lines within the relief regions as depicted in FIGS. 3 and 4.

Figure 5:
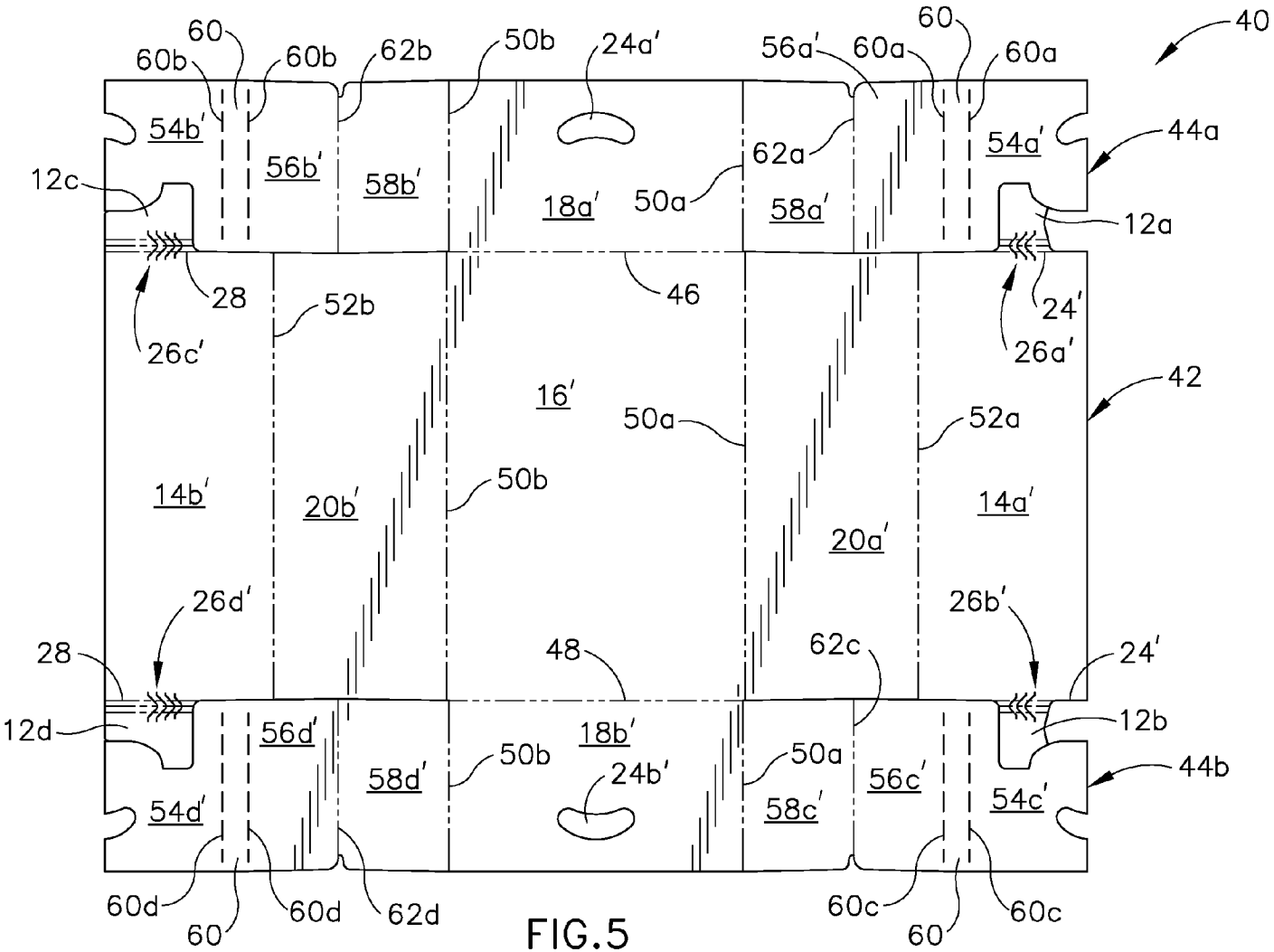
FIG. 5 is a plan view of a cut and scored paperboard blank for forming the container in FIGS. 1 and 2 in accordance to the present invention.

FIG. 5 is a plan view of a cut and scored paperboard blank 40 for forming the container 10 in FIGS. 1 and 2 in accordance to the present invention. The blank 40 is substantially flat symmetrical with respect to its longitudinal axis thereof. The blank 40 is preferably an integral piece of a material such as continuous sheet of conventional corrugated paperboard. The blank 40 is cut along its outer margins to form its specific shape. The blank 30 is divided into a first section 42, a second section 44*a*, a third section 44*b* by two substantially parallel longitudinal fold lines 46, 48. The first section 42 is defined by the bottom panel wall 16' having two side wall panels 20*a*', 20*b*' foldably joined thereto and respective first and second top wall panels 14*a*', 14*b*' foldably joined to the respective side wall panels 20*a*', 20*b*'. The respective side wall panels 20*a*', 20*b*' are foldably joined to the respective longitudinal edges of the bottom wall 16' via fold lines 50*a*, 50*b* and the respective first and second top wall panels 14*a*', 14*b*' are foldably joined to the respective longitudinal edges of the side wall panels 20*a*', 20*b*' via fold lines 52*a*, 52*b*. The top wall panel 14*a*' comprises a pair of first end sealing flaps 12*a*', 12*b*' and the second top wall panel 14*b*' comprises a pair of second end sealing flaps 12*c*', 12*d*'. The respective first end sealing flaps 12*a*', 12*b*' are foldably joined from respective opposed lateral free edges of the first top wall panel 14*a*' via fold lines 24' and the respective second end sealing flaps 12*c*', 12*d*' are foldably joined from respective opposed lateral free edges of the second top wall panel 14*b*' via fold lines 28'.

Interposed with respective fold lines 24', 28' are relief profiles 26*a*', 26*b*', 26*c*', and 26*d*' which are arranged cuts that lie substantially transverse the respective fold lines 24, 28 as discussed in detail hereinabove. When the blank 40 is constructed, the respective second and third sections 44*a* and 44*b* are defined as respective end walls 18*a*, 18*b* and they are mirror image of one another with respect to longitudinal axis of the blank. The section 44*a* comprises an end wall panel 18*a*' defined by fold lines 50*a*, 50*b* and respective reinforcing panels 54*a*', 56*a*', 58*a*' and respective reinforcing panels 54*b*', 56*b*', 58*b*' are foldaly joined to respective lateral edges of the bottom wall 16'. Similarly, the third section 44*b* comprises an end wall panel 18*b*' defined by fold lines 50*a*, 50*b* and respective reinforcing panels 54*c*', 56*c*', 58*c*' and respective reinforcing panels 54*d*', 56*d*', 58*d*' are foldaly joined to respective lateral edges of the bottom wall 16'. Four identical diagonal corner panels 60 are formed on the section 44*a* and 44*b* and they are defined by respective pairs of fold lines 6*a*, 60*b*, 60*c*, and 60*d*.

For example, two of the diagonal corner panels 60 are formed on section 44*a* and the other two diagonal corner panels 60 are formed on the section 44*b*. Each of the diagonal corner panels 60 is formed between the respective reinforcing panels 54*a*', 56*a*'; 54*b*', 56*b*'; 54*c*', 56*c*'; and 54*d*', 56*d*. The diagonal corner panels 60 significantly enhances the stacking strength of the container 10 and helps to stiffen the structure of the container 10 to resist both outward and inward flexing of both the end walls and sidewalls of the container 10. The respective reinforcing panels 56*a*', 58*a*' and 56*b*', 58*b*' are defined by respective fold lines 62*a*, and 62*b*. Similarly, the respective reinforcing panels 56*c*', 58*c*' and 56*d*', 58*d*' are defined by respective fold lines 62*c*, 62*d*. Two handholds opening 24*a*', 24*b*' each of which is formed on the respective end wall panels 14*a*', 14*b*'. Although the blank 40 is characterized as having side panels and end panels, but one of the ordinary skilled in the art would appreciate that the end panels can be defined as side panels as well and the characterization of the side panels and end panels have no effect on the function or utility of the blank 40.

The manual folding of blank 40 to construct the container 10 is easily accomplished. However, an ordinary skilled in the art would appreciate that a folding machine automatically performs the forming operations. Starting with second section 44*a*, reinforcing panels 54*a*', 56*a*', 58*a*' and reinforcing panels 54*b*', 56*b*', 58*b*'are simultaneously folded at the right angle with respect to the end wall panel 18*a*' via respective fold lines 50*a*, 50*b* and the end wall panel 18*a*' is now folded at the right angle with respect to the bottom wall panel 16'. Similarly, reinforcing panels 54*c*', 56*c*', 58*c*' and reinforcing panels 54*d*', 56*d*', 58*d*' are simultaneously folded at the right angle with respect to the end wall panel 18*a*' via respective fold lines 50*a*, 50*b* and the end wall panel 18*b*' is now folded at the right angle with respect to the bottom wall panel 16'. Next, the side wall panels 20*a*', 20*b*' are folded at right angle with respect to the bottom wall panel 16' and then the respective reinforcing panels 58*a*', 58*b*', 58*c*', and 58*d*' are glued to the respective side walls panels 20*a*', 20*b*'. Next, the reinforcing panels 56*a*', 58*b*', 56*c*', and 56*d*' are coextensively overlapped onto the reinforcing 58*a*', 58*b*', 58*c*', and 58*d*' and are glued thereto and the reinforcing panels 54*a*', 54*b*', 54*c*', 54*d*' are glued to the respective end wall panels 18*a*', 18*b*' while the respective diagonal corner panels 60 is formed therebetween at the respective corners of the container 10.

In use, Variety of products such as beef/poultry, but not limited to, are placed into the interior space 22 and the first and second top wall panels 14*a*, 14*b* are folded toward one another in an overlapping relationship to cover the interior space 22 and finally, the respective first and second end sealing flaps 12*a*, 12*b*, 12*c*, 12*d* are glued to the end walls 18*a*, 18*b* to enclose the container 10 as depicted in FIG. 2.

In sum, one advantage of the present invention is that the end sealing flaps 12*a*, 12*c* or end sealing flaps 12*b*, 12*d* are not overlapped. Another advantage is that the respective first and second end sealing flaps 12*a*, 12*b*, 12*c*, and 12*d* are strategically positioned so as to substantially increase the strength of the hand-hold area 24*a* when compared to the overlapping configuration of the end sealing flaps. Furthermore, the end sealing flaps of the present invention significantly improves the attaching means of the sealing flaps to the end walls 18*a*, 18*b*, irrespective of the position of the end sealing flaps and it reduces customer re-work cost. The container 10 with the first and second end sealing flaps 12*a*, 12*b*, 12*c*, and 12*d* is constructed from a single blank using one piece of equipment and thus presents a great cost savings over a container formed from two separate blanks Those skilled in the art will appreciate that the present invention may be used with any known blank and container style. For example, the present invention is usable to form any variety of slotted blank/container such as, regular, overlap, center special, center special overlap, full overlap, center special full overlap, half slotted container with cover, half slotted box with half slotted partial cover and full telescope half slotted box. Additionally, the present invention is usable with any style of container such as, design, double cover, bulk bin, bliss, recessed end, double thickness score line, double or triple side box. Further, the present invention is usable with additional blank or container items, for example, one, two or three piece folders, shells, tubes, partitions and any style of inner packing form.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A container comprising:

a bottom wall, opposite sidewalls, and opposite end walls all of which foldably joined to one another to form an interior space to receive products therein, first and second top wall panels each of which being foladbly joined to respective longitudinal edges of the opposite sidewalls, a pair of hand holes each of which being formed on the opposite end walls, a first pair of end sealing flaps each of which being foldably joined to respective lateral edge of the first top wall panel wherein the first pair of the end sealing flaps being aligned with the longitudinal edge of the top wall panel and being folded downwardly to position the adjacent respective hand holes and secured to the respective opposite end walls, a second pair of end sealing flaps each of which being foldably joined to respective lateral edge of the second top wall panel wherein the second pair of the end sealing flaps is offset from the longitudinal edge of the second top wall panel and being folded downwardly to position the adjacent respective hand holes and secured to the respective opposite end walls, wherein the respective first and second pairs of the end sealing flaps include a respective length in which the length of each first sealing flaps is longer than the length of each second sealing flaps, and wherein the first and second top wall panels being capable of partially overlapped to cover the interior space without each of the respective first and second end sealing flaps being overlapped with one another when the container being enclosed with the product.

2. A single unitary blank for making a container having a bottom wall, opposite sidewalls, opposite end walls, first and second top wall panels each of which includes respective longitudinal and lateral edges, the blank being cut and scored to define a first section, a second section, and a third section wherein:

the first section being defined by the bottom panel wall having two side wall panels foldably joined thereto and the respective first and second top wall panels being foldably joined to the respective side wall panels, each of the first and second top wall panels comprises a corresponding respective first and second pair of end sealing flaps being foldably joined to respective opposed lateral free edges of the respective first and second top wall panel;

the second section comprises one of the opposed end wall panel having two opposed respective reinforcing panels wherein each of the respective opposed reinforcing panels being foldaly joined to a respective lateral side of the end wall panel;

the third section comprises the other opposed end wall panel having two opposed respective reinforcing panels wherein each of the respective opposed reinforcing panels being foldably joined to a respective lateral side of the other end wall panel;

four identical diagonal corner panels being formed on the second and third sections, two of the diagonal corner panels are formed on second section and the other two diagonal corner panels are formed on the third section, each of the diagonal corner panels is formed between the respective reinforcing panels; and wherein the first top wall panel includes a first pair of end sealing flaps each of which being foldably joined to the respective opposed lateral edges of the first top wall panel, each of the first pair of the end sealing flaps being aligned with the longitudinal edge of the top wall panel and wherein the second top wall panel includes a second pair of end sealing flaps each of which being foldably joined to the respective lateral edges of the second top wall panel, each of the second pair of the end sealing flaps being offset from the longitudinal edge of the second top wall panel and wherein each of the first pair of end sealing flaps includes a length $L_1$ and each of the second pair of end sealing flaps includes a length $L_2$ such that the length $L_1$ is longer than the length $L_2$.

* * * * *